United States Patent [19]

Okuda et al.

[11] Patent Number: 4,655,582

[45] Date of Patent: Apr. 7, 1987

[54] AUTOMATIC DUPLEX ELECTROPHOTOGRAPHIC COPYING MACHINE

[75] Inventors: Masakiyo Okuda, Kashiwara; Kazuyuki Ohnishi, Nara, both of Japan

[73] Assignee: Sharp Kabushiki Kaisha, Osaka, Japan

[21] Appl. No.: 814,241

[22] Filed: Dec. 27, 1985

[30] Foreign Application Priority Data

Dec. 27, 1984 [JP] Japan ..... 59-276571

[51] Int. Cl.[4] ..... G03G 15/00

[52] U.S. Cl. ..... 355/14 R; 355/14 SH

[58] Field of Search ..... 355/14 SH, 14 R, 3 SH, 355/23, 24, 25; 271/288, 289, 298

[56] References Cited

FOREIGN PATENT DOCUMENTS 57-191661 11/1982 Japan ..... 355/14 SH 57-197560 12/1982 Japan ..... 355/14 SH

*Primary Examiner*—Arthur T. Grimley

*Assistant Examiner*—J. Pendegrass

*Attorney, Agent, or Firm*—Birch, Stewart, Kolasch & Birch

[57] ABSTRACT

An automatic duplex electrophotographic copying machine having a single side copying-related transport passage communicating from a paper supply section through a copying process section to a discharge outlet, a duplex copying-related transport passage located under the single side copying-related transport passage and communicating from the vicinity of the discharge outlet to the vicinity of the paper supply section, an intermediate tray provided in the approximate center of the duplex copying-related transport passage, and a plurality of bins mounted at the discharge outlet to store discharged copy papers, comprises a detector provided at the paper supplying side of the intermediate tray of the duplex copying-related transport passage to detect the picture image density on a copy paper; and a storage bin selection unit for delivering a defective copy paper to a particular bin among the plurality of bins when the detector does not detect any picture image on the copy paper while the copy paper is passing the position of the detector.

2 Claims, 6 Drawing Figures

AUTOMATIC DUPLEX ELECTROPHOTOGRAPHIC COPYING MACHINE

BACKGROUND OF THE INVENTION

The present invention relates to an automatic duplex electrophotographic copying machine having a duplex copying-related transport passage under a single side copying-related transport passage and an intermediate tray provided in the way of the duplex copying-related transport passage, in which a copy paper having a transferred image on one side is temporarily stored in the intermediate tray before being fed to a copying process section.

To meet the recent demand for simplified copying operation and multiple functions of a copying machine, various types of copying machines with automatic duplex copying function have been introduced to the market. In such an automatic duplex copying machine, a duplex copying-related transport passage is installed under a single side copying-related transport passage, communicating from a copy paper discharge outlet to the upper stream of the copying process section. An intermediate tray and switch-back means for reversing the transport direction of a copy paper are provided in the way of the duplex copying-related transport passage. Means for selecting transport direction of a copy paper is also provided in the vicinity of the copy paper discharge outlet. In the single side copying mode, a copy paper having a transferred image on one side is transported to be discharged outside the copying machine. In the duplex copying mode, the copy paper is transmitted to the duplex copying-related transport passage and temporarily stored in the intermediate tray. When the original document on the document rest is replaced with a new original document, the copy paper having a transferred image on one side is transmitted from the intermediate tray to the copying process section where the new original document is copied on the other side of the copy paper.

In operating the conventional automatic duplex electrophotographic copying machine of the above mentioned construction, two or more copy papers may be supplied simultaneously in a layer to the copying process section when the first original document is to be copied. If this occurs, a blank copy paper on which no image is transferred on neither side enters the intermediate tray. When the duplex copying process starts, the blank copy paper is supplied to the copying process section. As a result, copy papers discharged after the duplex copying process include a defective copy paper that has no image transferred on the first side. In general, the operator cannot be informed even if two or more copy papers are supplied to the copying process section for copying on the first side. Besides, the conventional automatic duplex copying machine is not equipped with means for separating blank copy papers from the single sided copy papers supplied from the intermediate tray. Therefore, it is unavoidable for the operator to continue duplex copying operation without noticing the defective copy paper. As a result, it is necessary to repeat duplex copying operation when the copy paper is found to be defective after it has been discharged from the paper outlet. This disadvantage significantly impairs the operation efficiency of the copying machine.

SUMMARY OF THE INVENTION

It is the object of the present invention to provide an automatic duplex electrophotographic copying machine with improved operation efficiency and with increased commodity value in which, if two or more copy papers have been supplied simultaneously in a layer for the first copying operation in the duplex copying mode, the resultant defective papers are separated from the normal copy papers to ensure perfect duplex copying operation.

Other objects and further scope of applicability of the present invention will become apparent from the detailed description given hereinafter. It should be understood, however, that the detailed description and specific examples, while indicating preferred embodiments of the invention, are given by way of illustration only; various changes and modifications within the spirit and scope of the invention will become apparent to those skilled in the art from this detailed description. The present invention comprises: detecting means provided at the paper supplying side of an intermediate tray in a duplex copying-related transport passage to detect the picture image density on a copy paper; and storage bin selection means for directing a copy paper on which no picture image is detected by the detecting means to a particular bin among a plurality of bins for storage of discharged copy paper.

BRIEF DESCRIPTION OF THE DRAWINGS

The present invention will be better understood from the detailed description given hereinbelow and the accompanying drawings which are given by way of illustration only, and thus are not limitative of the present invention in which.

DESCRIPTION OF THE INVENTION

Figure 2:
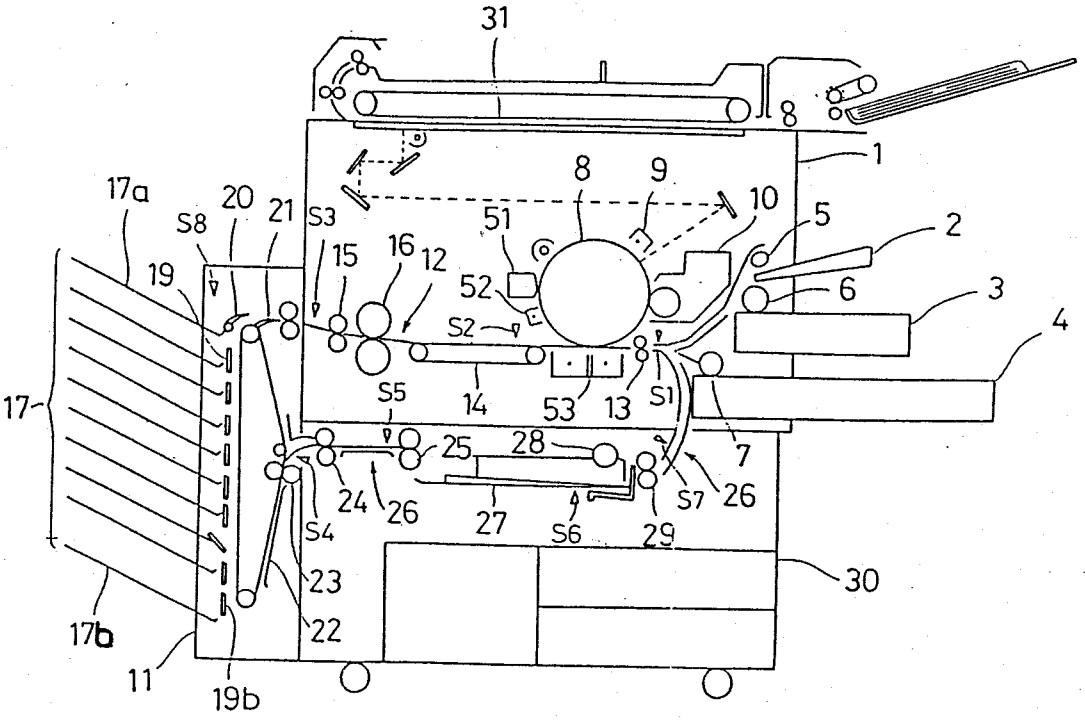

FIG. 2 is a sectional front view schematically showing the construction of an embodiment of the automatic duplex copying machine of the present invention.

1 is a copying machine main body. The paper feeding section in the right part of the copying machine 1 comprises a manual paper feed tray 2 and an upper and lower paper feed cassettes 3 and 4 provided under the manual paper feed tray 2. The manual feed tray 2 is used for supplying a small quantity of papers or papers of a special quality or thickness. Papers of an identical size are stored in each of the paper feed cassettes 3 and 4. Paper feed rollers 5, 6 and 7 are provided near the leading ends of the manual paper feed tray 2 and upper and lower paper feed cassettes 3, 4, respectively. Copy papers are supplied from the manual paper feed tray 2 or either of the upper or lower paper feed cassette 3 or 4 as selected by the operator, by rotation of the corresponding paper feed roller. A photoreceptor drum 8 is mounted in the approximate center of the copying machine 1. The photoreceptor drum 8 constitutes a copying process section together with an electric charger 9, developing unit 10, transfer/separation charger 53, charge remover 52 and cleaner 51 which are arranged around the photoreceptor drum 8. Within the copying machine 1, PT rollers 13, transport belt 14 and discharge rollers 15 constitute a single side copying-related transport passage 12 communicating from the paper feeding section through the copying process section to the discharge outlet in the left of the copying machine 1. Fixing rollers 16 are provided between the transport belt 14 and discharge rollers 15. The fixing rollers 16 heat or apply a pressure to a copy paper on which a visualized image are transferred by the copying process section, to fix the developing agent onto the copy paper surface.

A sorter 11 is provided at the paper discharge outlet of the copying machine 1. Multiple bins 17 for storing copy papers are vertically arranged in the sorter 11. A feed belt 18 is also provided between rollers in the sorter 11 so that, together with a delivery guide 19 provided for each of the bins 17 near the end to the side of the feed belt 18, it leads a copy paper into the sorter 11. By operating the delivery guides 19 in turn, copy papers discharged from the copying machine are guided to the appropriate bins. Therefore, when multiple different original documents are successively copied, the resultant copy papers are automatically sorted into the bins 17. When one original document is being copied, a gate 20 closes the passage toward the delivery guides 19 so that copy papers are delivered onto the top bin 17*a*. A switchback transport passage 22 having reversed transport rollers 23 is provided at the lower part of the feed belt 18 on the side facing the copying machine 1. In the duplex copying mode, when the first side copy operation completes, a gate 21 opens the switch-back transport passage 22 to lead the copy paper to the switch-back transport passage 22. When the trailing end of the copy paper passes a sensor S4, the rotation of the transport rollers 23 is reversed so that the copy paper having a transferred image on one side is re-directed into a mount 30.

A duplex copying-related transport passage 26 including transport rollers 24, 25, 29, an intermediate tray 27 and a feed roller 28 is provided within the mount 30. The copy paper having a transferred image on one side is directed into the mount 30 and conveyed by the rotating transport rollers 24 and 25 into the intermediate tray 27 for temporary storage. When the original document placed on a document rest 31 is replaced with a new one after the preset number of copies has been made, the feed roller 28 and transport rollers 29 start rotation so that a single sided copy paper is fed from the intermediate tray 27 toward the copying process section through the PT rollers 13. Thus, the new original document is copied on the other side of the copy paper. The copy paper now having transferred images on both sides is discharged through the discharge rollers 15.

The single copying-related transport passage 12, sorter 11, duplex copying-related transport passage 26 and intermediate tray 27 are equipped with sensors S1~S8. The sensors S1 through S6 and S8 detect presence of a copy paper at their respective positions and input information to CPU. The timings with which the rollers, belts, guides and gates operates depend upon the information from the sensors. The sensor S7 provided at the paper supplying side of the intermediate tray 27 in the duplex copying-related transport passage 26 is detection means related to the present invention. It comprises a light emitting element and a photo sensing element. The sensor S7 detects the color density of a copy paper.

Figure 3:
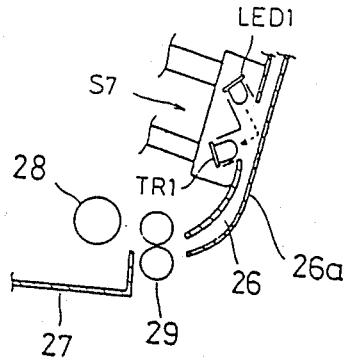
FIG. 3 shows the layout of the detecting means used in the embodiment.

FIG. 3 shows the layout of the detection means used in the present embodiment.

The sensor S7 as the detection means of the present invention is mounted in that portion of the duplex copying-related transport passage 26 after the transport rollers 29 provided near the paper supplying side of the intermediate tray 27. As mentioned above, the sensor S7 comprises a light emitting element LED 1 and a photo transistor TR1 as a photo sensing element. A paper guide plate 26*a* constituting a part of the duplex copying-related transport passage 26 has the mirror-finished inner surface, so that it reflects the light beam emitted from the LED 1 in the direction indicated by a broken line in the figure to the photo transistor TR1. When a copy paper sent by the rotating transport rollers 29 from the intermediate tray 27 reaches the sensor S7, the amount of reflected light decreases because it is absorbed by the copy paper. When the transferred image portion of the copy paper reaches the sensor S7, the amount of reflected light detected by the photo transistor TR1 further reduces because the transferred image absorbes the light from the light emitting element LED1.

Figure 4:
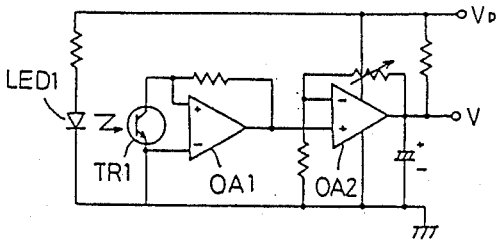
FIG. 4 is a circuit diagram of the detecting means, FIGS. 5(A) and 5(B) graphs indicating the variation in the circuit output voltage of the detecting means.

FIG. 4 is a circuit diagram of the detection means. The photo transistor TR1 is connected between the two input terminals of an operational amplifier OA1. The output terminal of the operational amplifier OA1 is connected to the non-inversion input terminal of an operational amplifier OA2. When a light beam from the light emitting element LED1 is received by the photo transistor TR1, the signal is photoelectrically converted. Then, the signal is amplified by the operational amplifier OA1 and inputted to the operational amplifier OA2 through the non-inversion input terminal. The operational amplifier OA2 constitutes an integrating circuit together with a CR circuit, so that it outputs a voltage V according to the voltage inputted through the non-inversion input terminal.

FIGS. 5(A) and 5(B) are graphs showing variation in the output from the detection means.

When no copy paper is present at the position of the sensor S7, light from the light emitting element LED1 is all reflected by the paper guide plate 26*a* and enters the photo transistor TR1. Accordingly, the output voltage of the detection means is the maximum value, V0. When the leading end of a copy paper supplied from the intermediate tray 27 reaches the position of the sensor S7 at the time "t1", the amount of light received by the photo transistor TR1 decreases. When the image portion reaches the position of the sensor S7, the amount of light received by the photo transistor TR1 further decreases by different amount depending upon the density of the image, so that the detection means output voltage V shown in FIG. 5(A). When the trailing end of the copy paper has passed the position of the sensor S7 at the time "t2", the light from the light emitting element LED1 is all reflected by the paper guide plate 26*a* to be directed to the photo transistor TR1, so that the output voltage resumes the maximum value, V0.

If a copy paper coming at the position of the sensor S7 is blank, there is no light absorption by the image. Accordingly, the output voltage between "t1" and "t2" is constant, though it is a little lower than the maximum value V0, as shown in FIG. 5(B). As mentioned above, the voltage outputted from the photo sensing circuit of the sensor S7 varies depending upon the image density on a copy paper. Therefore, the presence or absence of a copy paper and the variation of the image on the copy paper can be known by comparing the voltage outputs.

Figure 1:
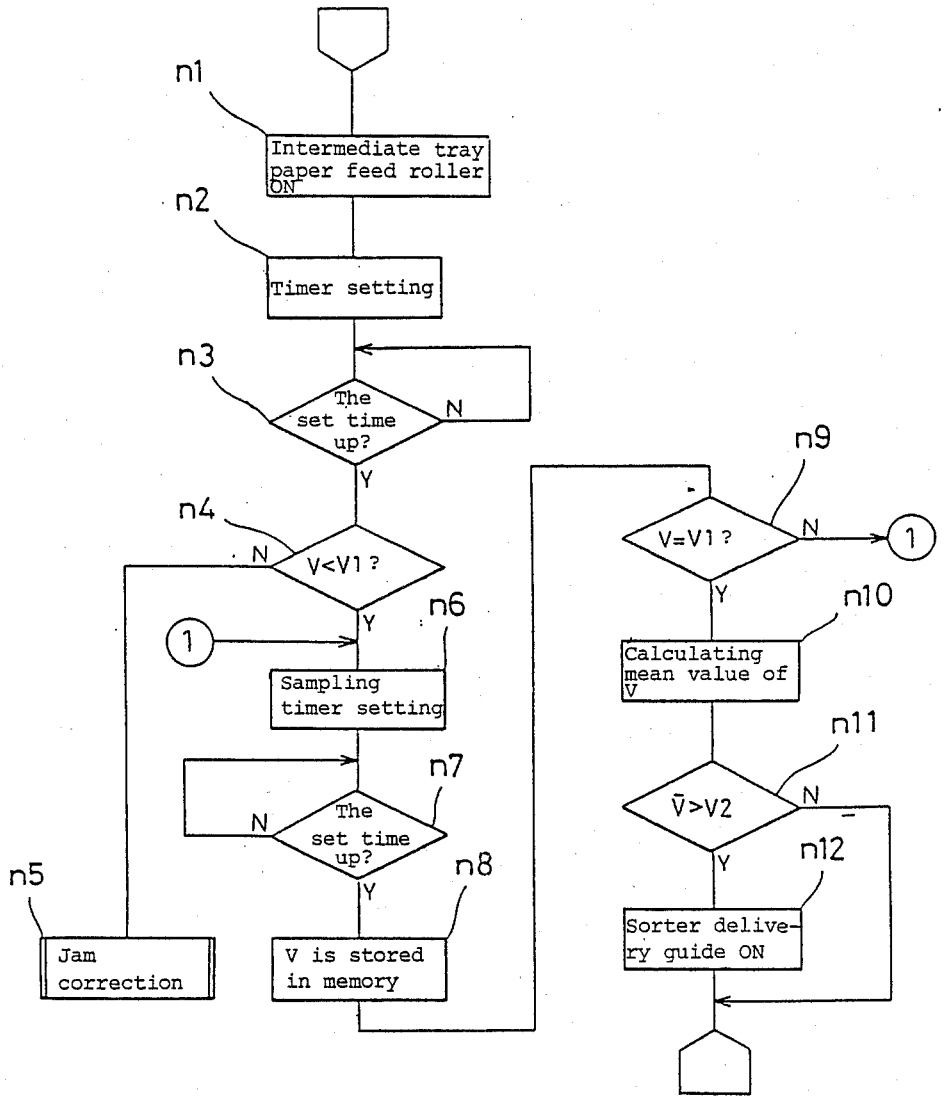
FIG. 1 is a flow chart showing the operation of a part of an embodiment of the automatic duplex copying machine of the present invention, FIG. 2 schematically shows the construction of the embodiment of FIG. 1.
Figure 6:
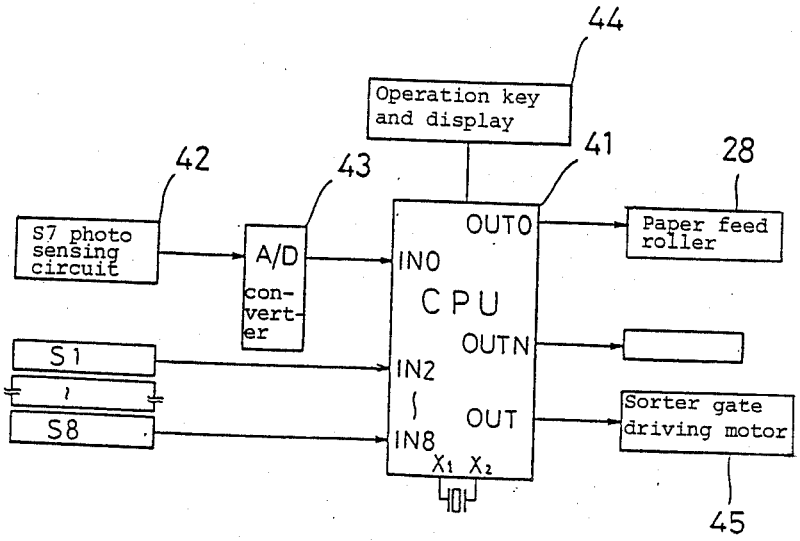
FIG. 6 is a block diagram of the control system of the above embodiment.

FIG. 6 is a block diagram of the control system of this embodiment. The voltage output from the photo sensing circuit of the sensor S7 is inputted through an A/D converter 43 to an input terminal IN0 of a CPU 41. Signals from the sensors S1 through S6 and S8 are inputted to input terminals IN2 through IN8, respectively. Motor-driving signals for actuating the paper feed roller 28, sorter gates and delivery guide are outputted from the output terminals of the CPU 41. FIG. 1 is a flow chart showing the control sequence of the above example.

At the start of copying operation for the second side of a copy paper in the duplex copying mode, the paper feed roller 28 of the intermediate tray 27 is actuated in step n1. (Hereinafter, step ni is simply referred to as "ni".) In n2, a jam detection timer is set. When the jam detection timer has counted up to the setting in n3, it is checked if the output signal V from the photo sensing circuit of the sensor S7 is smaller than V1 in n4. The jam detection timer has been set for the time required for the leading end of a copy paper stored in the intermediate tray 27 to reach the position of the sensor S7 after the paper feed roller 28 starts rotation. If the voltage output from the photo sensing circuit of the sensor S7 does not drop below V1 in n4, it is assumed the copy paper is not normally conveyed but jammed somewhere between the intermediate tray 27 and the sensor S7. In such a case, the jammed copy paper is corrected in n5.

Figure 5:
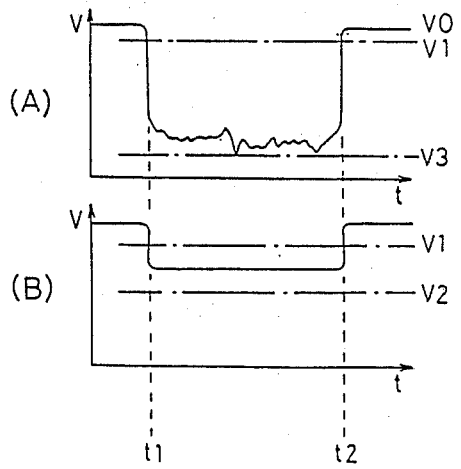

If the voltage output from the photo sensing circuit of the sensor S7 drops below V1 in n4, it is assumed the copy paper has been normally conveyed. Then, the sequence proceeds to n6 where a sampling rate-setting timer for voltage outputs from the photo sensing circuit is set. If it is determined in n7 that the sampling rate timer has counted up to the setting, voltage output signals obtained from the photo sensing circuit during the counted period is stored in a memory in n8. Then in n9, it is checked if output voltage V is equal to the setting V1. If not equal, the sequence returns to n6. The voltage output from the photo sensing circuit of the sensor S7 should remain dropped so far as a copy paper is passing the position of the sensor S7. When the trailing end of the copy paper has passed the position of the sensor S7, however, the output voltage resumes the value V0. On the way of resuming the value V0, the output voltage becomes equal to the setting V1. Accordingly, whether the copy paper is passing the position of the sensor S7 or whether the trailing end of the copy paper has passed the position of the sensor S7 can be known by checking that the output voltage V is equal to the setting V1 in n9. Voltage outputs V sampled between t1 and t2 shown in FIG. 5 are measured and stored during the cycle of the steps n6→n7→n8→n9→n6.

If the output voltage V is equal to the setting V1 in n9, the sequence proceeds to n10 where the mean value of the stored data is calculated. In n11, the calculated mean value is compared with the setting V2 shown in FIG. 5. The setting V2 is a little lower than the voltage outputted from the photo sensing circuit of the sensor S7 while a blank copy paper is passing the position of the sensor S7. If it is determined in n11 that the mean value is larger than the setting V2, therefore, it is assumed that no image has been copied onto the copy paper. In such a case, the delivery guide **19*b* of the sorter is turned ON in n12 to deliver the blank copy paper to the bottom bin 17*b* among the vertically arranged bins 17**.

Due to the above operation, if two or more copy papers are supplied for the first copying operation in the duplex copying mode, resulting in blank copy papers being fed from the intermediate tray 27, the blank papers are detected by the sensor S7 and delivered to a particular bin in the sorter. When duplex copying operation has been completed, therefore, the blank copy papers are isolated from the other normal copy papers. Moreover, on detecting a blank copy paper, the sensor S7 disables the counter from counting the number of copying operations so that the preset number of normal duplex copy papers is obtained with defective copy papers separated therefrom.

To provide for copying on colored papers or on papers having printed patterns, the mean output voltage value calculated in n10 for the first copy paper supplied from the intermediate tray 27 may be stored in the memory as a reference for the subsequent operation. In this case, a defective blank copy paper is detected and isolated, based on the comparison of the reference value with the mean output voltage calculated for each subsequent copy paper.

If a color sensor is used as detection means, the present invention is applicable in multi-color duplex copying operation.

According to the present invention, as understood from the above, if two or more copy papers are supplied for the first copying operation in the duplex copying mode, resulting in blank copy papers being fed from the intermediate tray 27, the blank copy papers are detected by the detection means and discharged to a particular bin. Thus, it is possible to prevent defective copy papers from mixing with normal copy papers when duplex copying process is over. Since it is no more necessary to check for defective copy papers after the copying operation, operation efficiency and commodity value of the copying machine increase remarkably.

While only certain embodiments of the present invention have been described, it will be apparent to those skilled in the art that various changes and modifications may be made therein without departing from the spirit and scope of the present invention as claimed.

What is claimed is:

1. An automatic duplex electrophotographic copying machine having a single side copying-related transport passage communicating from a paper supply section through a copying process section to a discharge outlet, a duplex copying-related transport passage located under said single side copying-related transport passage and communicating from the vicinity of said discharge outlet to the vicinity of said paper supply section, an intermediate tray provided in the approximate center of said duplex copying-related transport passage, and a plurality of bins mounted at said discharge outlet to store discharged copy papers, comprising: detection means provided at the paper supplying side of the intermediate tray of said duplex copying-related transport passage to detect the picture image density on a copy paper; and storage bin selection means for delivering a defective copy paper to a particular bin among the plurality of bins when said detection means do not sense any picture image on the copy paper while the copy paper is passing the position of the detection means.

2. The automatic duplex electrophotographic copying machine as claimed in claim 1, in which said detection means are composed of a sensor for outputting signals corresponding to the picture image density, means for calculating a mean value or integrated value of the picture image density detected for each copy paper by said sensor, and means for comparing the mean picture image density of the second or subsequent copy paper with the mean picture image density of the first copy paper as a reference, and in which said bin selection means deliver to said particular bin any copy paper whose mean picture image density is different from that of the first copy paper.

* * * * *